United States Patent [19]

Maloeuvre et al.

[11] Patent Number: 4,766,989

[45] Date of Patent: Aug. 30, 1988

[54] REMOVABLE ATTACHMENT DEVICE FOR SHOPPING CARTS AND THE LIKE

[76] Inventors: Robert Maloeuvre, 65, rue Jean Gutenberg; Jean-Yves Loirat, 90, rue Jean Bart, both of F-44600 Saint-Nazaire, France

[21] Appl. No.: 907,732

[22] PCT Filed: Dec. 26, 1985

[86] PCT No.: PCT/FR85/00374

§ 371 Date: Oct. 2, 1986

§ 102(e) Date: Oct. 2, 1986

[87] PCT Pub. No.: WO86/04174

PCT Pub. Date: Jul. 17, 1986

[51] Int. Cl.[4] ..... G07F 17/00

[52] U.S. Cl. ..... 194/257; 194/905

[58] Field of Search ..... 194/905, 253, 257

[56] References Cited

U.S. PATENT DOCUMENTS

| | | | |
|---|---|---|---|
| 2,753,970 | 7/1956 | Breeler | 194/283 |
| 3,163,277 | 12/1964 | Naef | 194/257 |
| 4,635,782 | 1/1987 | Wieth et al. | 194/905 X |
| 4,637,507 | 1/1987 | Ricouard et al. | 194/905 X |

FOREIGN PATENT DOCUMENTS

| | | |
|---|---|---|
| 0070028 | 1/1983 | European Pat. Off. . |
| 0070997 | 2/1983 | European Pat. Off. . |
| 2725530 | 12/1978 | Fed. Rep. of Germany . |
| 2900367 | 7/1979 | Fed. Rep. of Germany . |
| 3303076 | 8/1984 | Fed. Rep. of Germany . |
| 82/01950 | 6/1982 | World Int. Prop. O. . |
| 84/04835 | 12/1984 | World Int. Prop. O. . |

*Primary Examiner*—F. J. Bartuska

*Attorney, Agent, or Firm*—Steele, Gould & Fried

[57] ABSTRACT

A device for removably attaching carts or the like such as used in supermarkets is comprised of a casing fixed to the handle of a cart. The casing is equipped with a plunger wherein a coin may be inserted into a coin housing in the plunger to release a locking key. The locking key can be affixed by means of a chain to either the casing of a preceding cart or to any other suitable support. Insertion of the locking key into the casing will release the plunger to allow the user to again gain access to the previously inserted coin.

3 Claims, 4 Drawing Sheets

REMOVABLE ATTACHMENT DEVICE FOR SHOPPING CARTS AND THE LIKE

Figure 1:
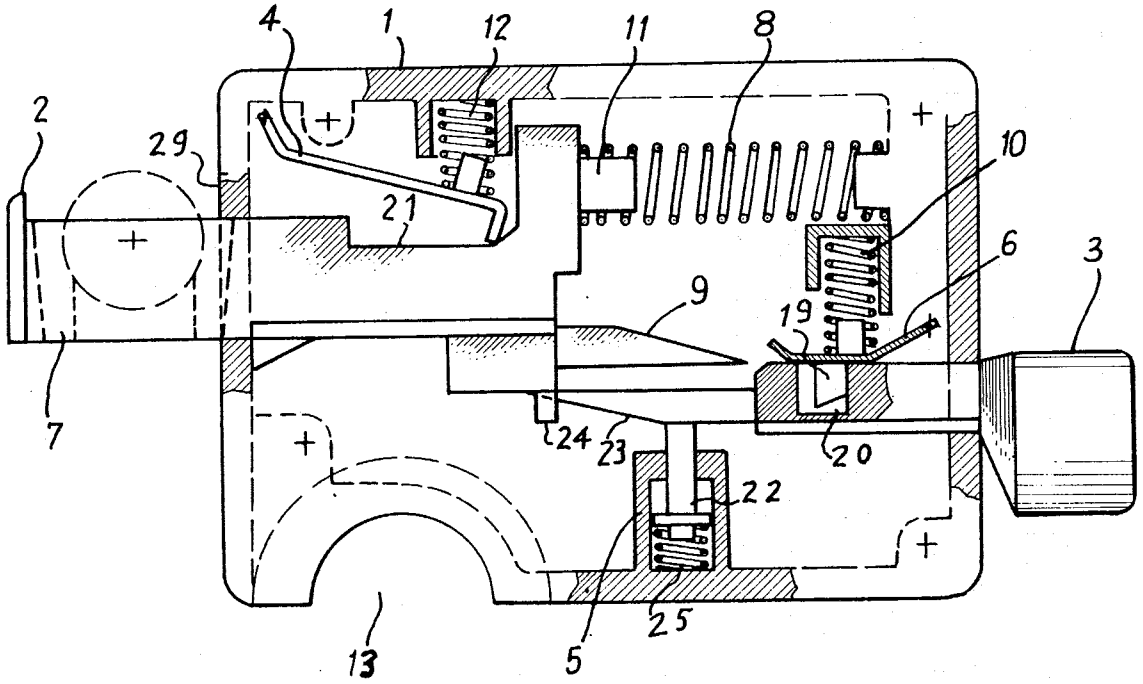

An object of the present invention is a removable attachment device intended in particular, but not exclusively, for stowing carts used by customers to make self-service purchases in large or medium-sized places such as supermarkets and hypermarkets.

It is known that after making their purchases and emtying the cart into their automobile trunk customers are in a hurry to leave and consequently not particularly motivated to return their cart to an appropriate place, set aside for this purpose, always assuming that they do not take the cart away in their automobile. As the stowing of the carts is left up to the public, they end up scattered about with the result that equipment and/or vehicles in the car park are damaged and persons may sometimes be injured. Because of this, personnel has to be specifically assigned to recovering and stowing the carts, which increases operating overhead. The present invention is based on the observation that with minimum effort on the part of each customer it is possible to limit the costs resulting from this lack of discipline. Exactly the same problem arises when a municipality makes available to the citizens of the town bicycles or other vehicles, which are usually left in the greatest possible disorder, and in railroad stations and airports in the case of baggage carts. At a more general level, the invention concerns the problem of returning to precise locations objects made temporarily available to the public free of charge. The objective is to render automatic the procedure known as the deposit system.

To this end there have already been proposed methods intended to promote the stowing of the objects whereby each of the vehicles is locked into a set of storage areas and each vehicle is fitted with a coin-operated device used to release an empty vehicle, the coin being returned when the vehicle is returned to one of the set of storage places. Devices operating by this method are described in the patents EP-A No. 0 070 997, WO-A No. 84 04835 and DE-A No. 33 03076, but these devices comprise complicated mechanisms and often tend to jam, especially in freezing weather, when there is an opening on the top of the unit.

A coin may equally well be replaced with a magnetic card or a token, for example, or on a more general level by any object having some value to carrier. The place in which the vehicles may be stored will be generally designated by the word "garage".

The invention concerns a device adapted to be fitted to a cart or the like comprising a casing attached to the cart adapted to release a key, to receive and to restore a coin by insertion of said key, characterized in that it comprises a plunger adapted to receive a coin spring-loaded by a return spring, the interior part of the plunger comprising a cam and a stub member the cam coming into contact with a part for releasing the key, the stub member coming into contact on displacement of the plunger with a locking lug attached to the casing.

When the coin is inserted into the plunger which is pushed inwards, the locking part is released and the vehicle is releasd. When it is returned to the garage, the insertion of a locking part releases the plunger and the coin may be extracted from it.

Figure 2:
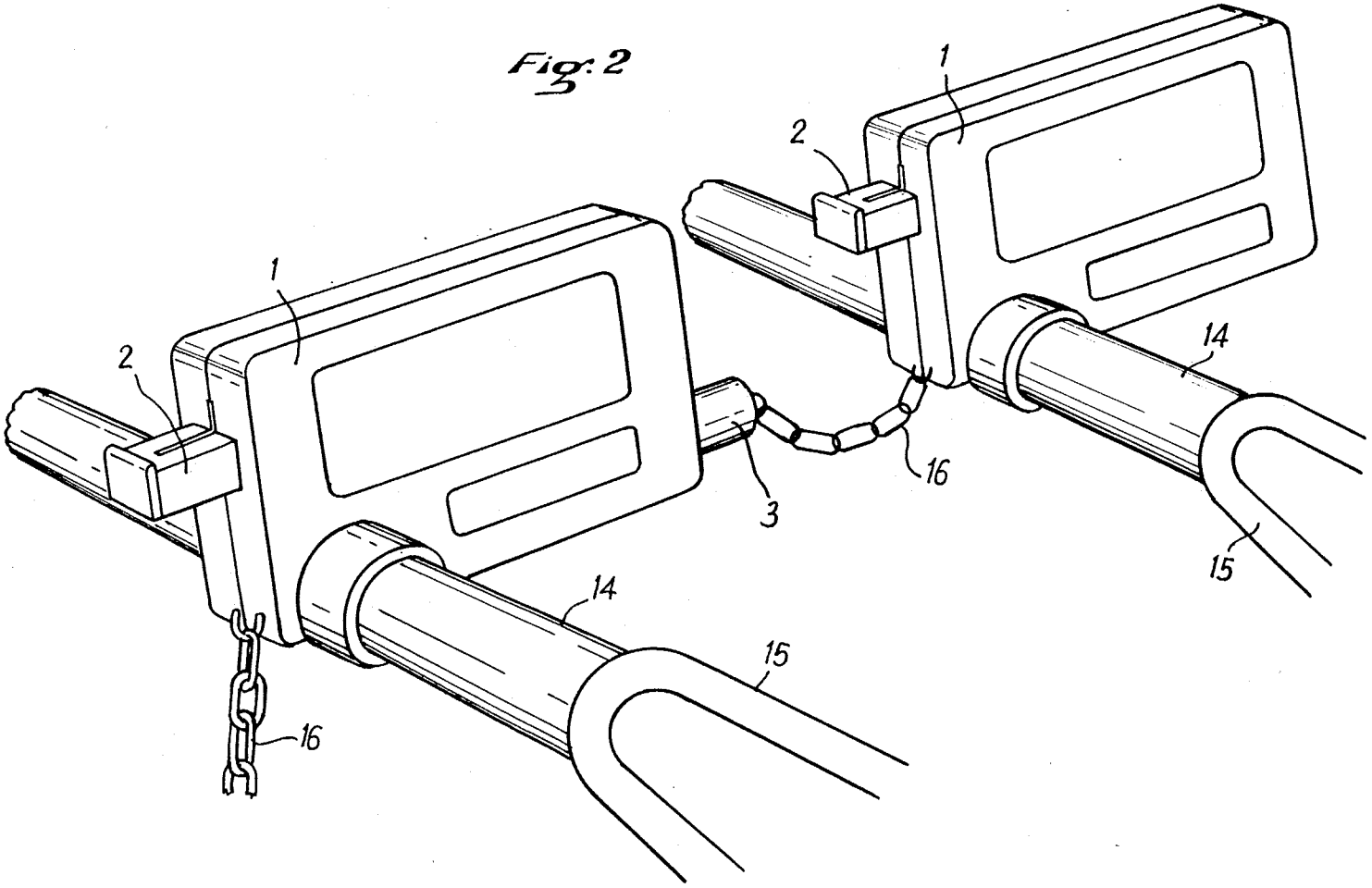
Figure 3:
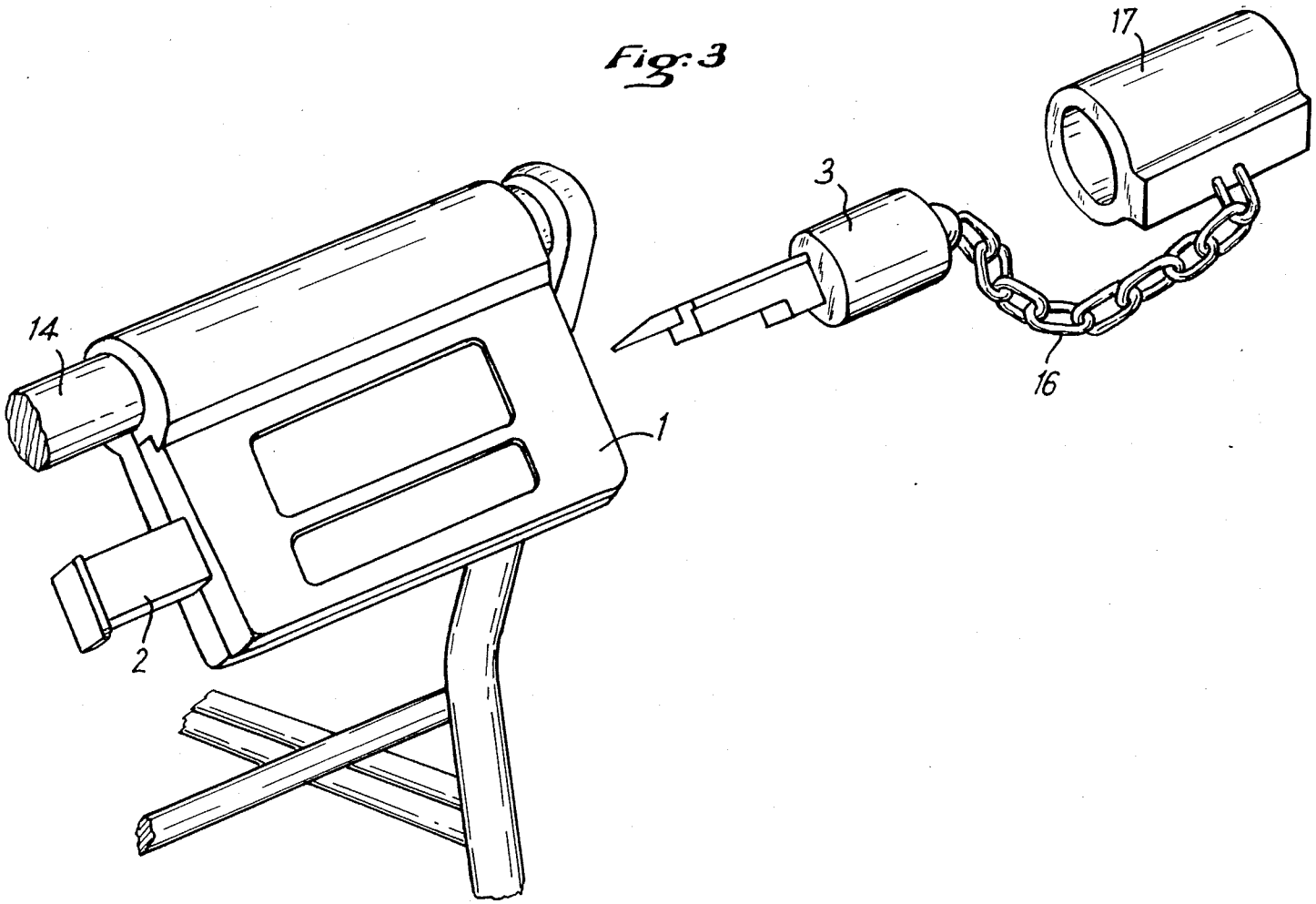
Figure 4:
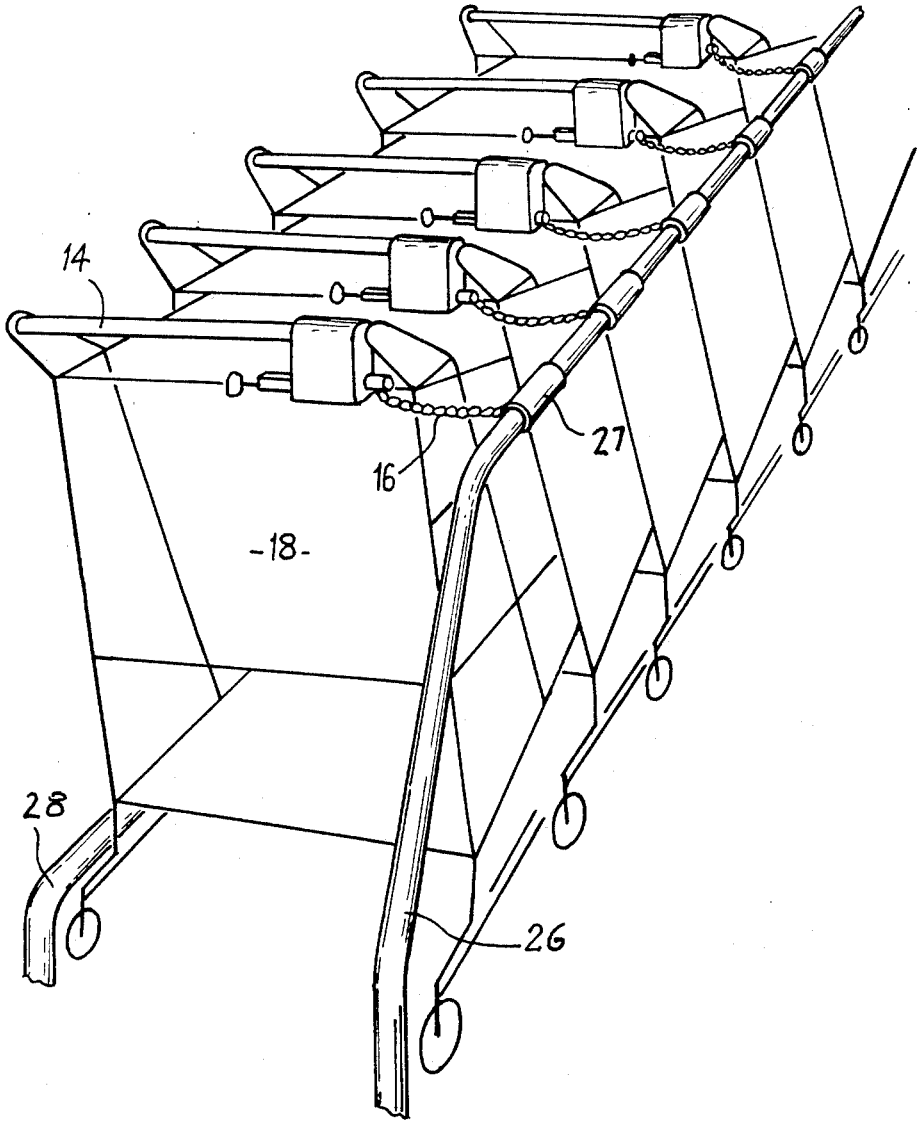

Other characteristics and advantages of the present invention will emerge from the following description of specific embodiments relating to the stowing of supermarket carts, given by way of non-limiting example only, and with reference to the drawings which show:

FIG. 1, a view of a device in accordance with the invention functioning with a coin;

FIG. 2, a partial view of the coupling between two carts before the rear cart is released;

FIG. 3, another embodiment of the invention;

FIG. 4, a view of a cart garage.

In FIG. 1, the device included in a casing 1, of which only the contour is seen, is permanently fixed by the notch 13 to the handle of a cart. The device comprises a plunger 2 which is movable in translation. The plunger 2 is fastened to a cam 9 and spring-loaded by a return spring 8. The position shown in FIG. 1 is the locked position of the cart, meaning that the locking part or member 3 which will be hereinafter designated "key" because of its shape, although in the device the key function is implemented by the coin, is locked inside the device by a part 6 spring-loaded by a return spring 10, the part 6 featuring a peg 19 inserted into the cavity 20 in the locking key 3. The plunger 2 has in its upper part, in FIG. 1, a notch 21 within which rests the end of a leaf spring 4 spring-loaded by a return spring 12. It is guided within the casing 1 by a slide (not referenced). The plunger 2 is provided with a support 7 adapted to receive a coin or, more generally, a deposit. The support 7 is of a size adapted to the dimensions of the coin intended to release the device which may be, for example, a ten francs coin in France or a one dollar coin in the United States. In practice, the device must be provided with information to unlock it. In the example shown this information is embodied in the dimensions of the coin. Only a coin of the appropriate size can enter the housing 7 to a predetermined depth and enter the casing 1 through the slot 29. In this device the insertion of a counterfeit coin, even if this makes it possible to release the mechanism, has no value to the "user" who can only hope to recover the same counterfeit coin on leaving. The plunger 2 is locked at the end of its forward travel by an abutment 5 comprising a lug 22 spring-loaded by a spring 25.

This device functions in the following way: when the customer arrives in the garage, he inserts a coin into the housing 7 in the plunger 2.

He pushes the plunger 2 towards the interior of the casing. With the plunger 2, the inclined plane 9 moves towards the right in the figure and raises the part 6 which lifts the peg 19. The key 3 is thus unlocked and may be extracted from the casing 1, which releases the corresponding cart. The movement of the plunger 2 is blocked by the contact of the leaf spring 4 in the bottom of the notch 21 and by the compression of the spring 8. During this movement the stub member 24 passes over the lug 22 which is held in the low position by the frustoconical front part of the key 3 forming a cam 23. The cam 9 of the plunger and the cam 23 of the key 3 are not in the same plane, of course. When the key 3 is removed, the lug 22 is raised by the spring 25 and locks the stub member 24. Thus it is not possible to pull out the plunger 2 and to remove the coin until a key 3 has been re-inserted into the casing 1, it being understood that as a general rule this new key 3 is not the original key. Naturally enough, the coin may only be inserted into the casing 1 if its dimensions correspond on the one hand to those of the housing 7 and the other hand to the opening 29 provided in the casing 1.

When, after using the cart, the customer inserts a key 3 into the casing ,the peg 22 is pushed down by the cam part 23. The stub member 24 is then released and the spring 8 expands, pushing out the plunger 2, which provides access to the coin or token in the housing 7.

If the customer does not insert any coin or inserts a coin of different dimensions to the intended coin, the plunger can be pushed in but this movement is blocked by the leaf spring 4 before the key 3 is released and the lug 19 lifted out of the cavity 20. If the coin is of the appropriate size it raises the leaf spring 4 to allow the plunger to move forward.

As is seen in the subsequent figures, the casing 1 is connected to a chain 16 which may be fastened at its other end either to another cart or to a fixed or semi-fixed point.

FIG. 2 shows an embodiment in which the coupling by the chain 16 is from cart to cart. It is known that such carts can be nested, their rear part being able to pivot anti-clockwise to permit the front part of another cart to pass beneath. When the carts are nested, the distance between two successive handles is in the order of 5 to 10 cm. In the FIG. 2 embodiment the casings 1 are mounted on the handle 14 of each cart perpendicularly thereto and substantially in the central part of each of the handles 14 situated in the rear upper part of each cart between the two rear uprights 15. Each casing 1 lies wholly within the profile of a cart which prevents any damage through contact. The position of the casings 1 means that it is very easy to insert a coin and to remove it on inserting a key 3, these operations being conducted at waist height without being necessary to bend over. As the plunger moves in a horizontal plane, there is no risk of the ocin P held in the housing 7 falling out. The plunger 2 is disposed towards the user and the length of the chain 16 is obviously less than the length of the casing 1 so that the key 3 of a cart cannot be inserted into the casing of the same cart. Likewise it is not possible to unlock the plunger of a first cart using a key of a second cart placed back-to-back with the first. The position of the casing 2 on the side of the device prevents any penetration by rainwater leading to freezing up of the mechanism in intemperate countries. In order to evacuate rainwater the housing 7 of each device is formed with a hole. Finally, the shape of the key 3 (which is seen more clearly in FIG. 3) prevents any fraudulent maneuvering using paper clips or iron wire for unauthorized recovery of the coins.

In the embodiment which has just been described the functioning of the device is and can only be purely mechanical. This is not the case with the second embodiment shown in FIGS. 3 and 4. Whereas previously each cart carried on its handle a casing 1 and a key 3 connected to the casing by a chain 16 or by any other form of coupling difficult to destroy, in this embodiment the key 3 remains hooked onto a fixed location and more precisely, as shown in FIG. 4, onto sleeves 27 fastened to a ramp 26 in a garage. In this second embodiment the casing 1 is advantageously disposed at one end of the handle 14 so that the slot for inserting the key 3 faces towards the outside of the cart, the plunger obviously facing towards the inside of the cart, the length of the substantially rectangular casing being parallel to the handle 14.

As seen in FIG. 4, a guide rail 28 is preferably provided opposite the ramp 26 at a distance therefrom substantially equal to the overall width of each cart. Thus the carts 18 are automatically and impeccably aligned and nested before the customers can recover the coin that they inserted initially.

In the cse of supermarket type carts, each cart may be fitted with a simple mechanical device such as that described hereinabove. In the case of vehicles the value of which is greater than that of carts it is possible to utilize a key 3 which may be electrically powered such as a reader of a badge or a magnetic card which is inserted into the casing and recovered as previously. If a card is left in a casing, its owner can be easily identified.

The casing 1 is advantageously molded from a strong and hard plastics material insensitive to low temperatures, the housing 7 being interchangeable, whereas the key is made of a light metal.

We claim:

1. A removalbe attachment device for carts or the like comprising a casing secured to the cart, the casing being adapted to receive a locking key, to receive and store a coin and to deliver the coin upon insertion of the said key;

a plunger reciprocally insertable into the casing, the plunger having a coin receiving housing to receive a correctly sized coin therein, the plunger being insertable into the casing only when a correctly sized coin is within the housing, the plunger being spring loaded by a return spring, the insertable portion of the plunger comprising a cam and a stub member;

a spring-loaded lug positioned interiorly of the casing, the lug being positioned to be contacted by the plunger stub member, the lug engaging the plunger stub member to normally prevent removal of the plunger;

a key removably insertable into the casing, the key being provided with a retaining cavity, the casing being equipped with a spring loaded peg and a peg release adapted to move the peg, the peg being urged within the retaining cavity of the key when the key is inserted into the casing to retain the key in association with the casing, the peg release being positioned to be contacted by the plunger cam when the plunger is inserted into the housing to lift the peg out of the retaining cavity to thereby allow removal of the key from the housing, the key comprising a cam positioned to move the said spring-loaded lug upon insertion of the key to release the plunger; and, a flexible coupling having two ends, one end of which is secured to the key, the other end of the flexible coupling being adapted to be secured in spaced location from the casing.

2. The device according to claim 1 characterized in that the casing is of rectangular shape and comprises an opening for receiving the plunger and an opening for receiving the key, these openings being disposed on opposite sides of the rectangle, the key being connected to the casing by the coupling, the length of which is less than the length of the casing.

3. The device of claim 2 wherein the cart comprises a transverse handle and an outside, and wherein the device is mounted at the center of the handle of the cart perpendicularly to the direction in which the handle extends, and wherein the plunger opening faces towards the ouside of the cart.

* * * * *